US006118380A

United States Patent [19]

Gannon

[11] Patent Number: 6,118,380

[45] Date of Patent: Sep. 12, 2000

[54] SWITCH ARRANGEMENT FOR CHILD FINDER APPARATUS

[76] Inventor: Heather Gannon, 6 Arch Rd., Norristown, Pa. 19401

[21] Appl. No.: 09/251,671

[22] Filed: Feb. 17, 1999

[51] Int. Cl.[7] ..... G08B 23/00

[52] U.S. Cl. ..... 340/573.4; 340/571

[58] Field of Search ..... 340/573.4, 573.1, 340/571, 572.8, 574

[56] References Cited

U.S. PATENT DOCUMENTS

| | | | |
|---|---|---|---|
| 4,573,042 | 2/1986 | Boyd et al. | 340/571 X |
| 4,587,516 | 5/1986 | Hiraki | 340/574 X |
| 4,694,284 | 9/1987 | Leveille et al. | 340/574 |
| 4,792,796 | 12/1988 | Bradshaw et al. | 340/539 |
| 4,837,559 | 6/1989 | Green, Sr. | 340/571 X |
| 5,005,002 | 4/1991 | Halperin | 340/574 |
| 5,319,349 | 6/1994 | Smith, III | 340/571 X |
| 5,640,144 | 6/1997 | Russo et al. | 340/568.1 |
| 5,652,569 | 7/1997 | Gerstenberger et al. | 340/573.4 |
| 5,661,460 | 8/1997 | Sallen | 340/573.4 |
| 5,689,240 | 11/1997 | Traxler | 340/573.4 |
| 5,714,931 | 2/1998 | Petite et al. | 340/539 |

*Primary Examiner*—Thomas Mullen
*Attorney, Agent, or Firm*—Henderson & Sturm LLP

[57] ABSTRACT

An improved child locator device 10 including a housing unit 11 provided with a rear face 24 equipped with an elongated clip arm 25 and containing a control unit 12 including an alarm signal speaker 22 for generating an alarm signal in response to the actuation of a first switch 33 responsive to the position of the clip arm 25 relative to the rear face 24 of the housing unit 11 and a second switch member 40 normally hidden by the clip arm 25 for overriding the first switch 33.

7 Claims, 1 Drawing Sheet

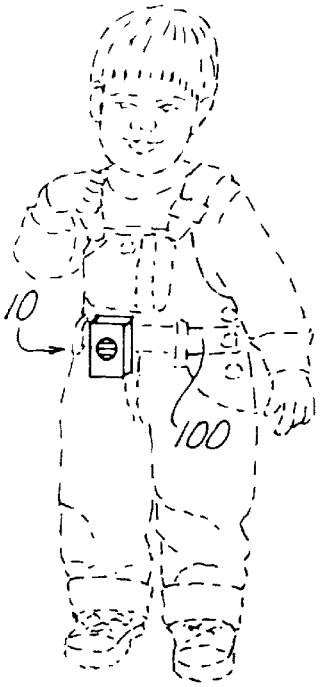
Fig. 1
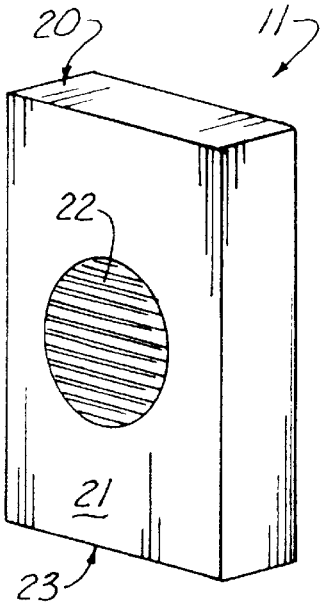
Fig. 2
Fig. 3
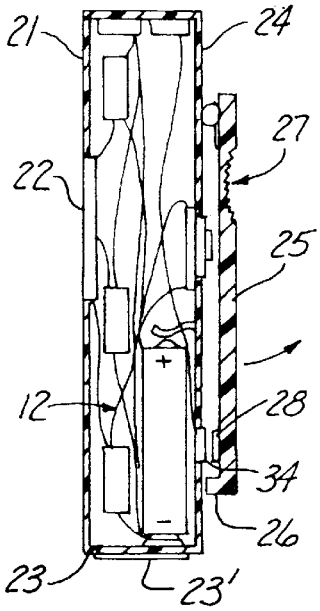
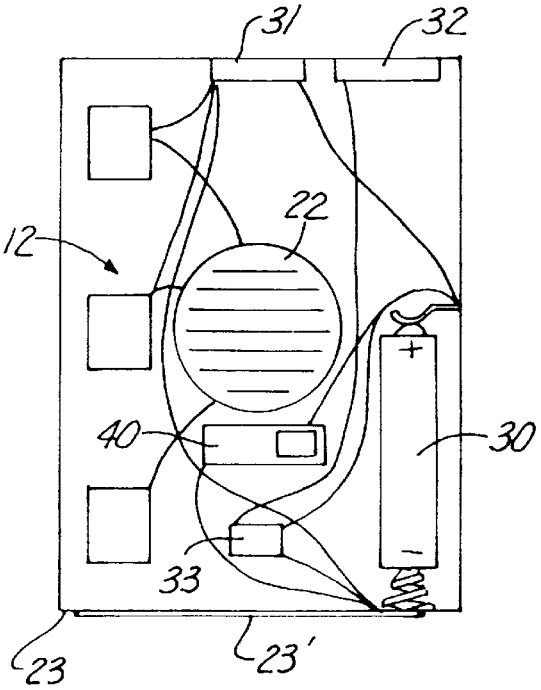
Fig. 4
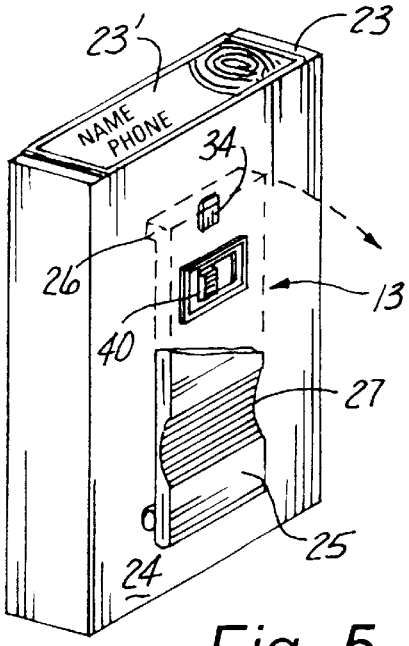
Fig. 5

SWITCH ARRANGEMENT FOR CHILD FINDER APPARATUS

BACKGROUND OF THE INVENTION

1. Field of the Invention

The present invention relates to the field of child finder or locator apparatus in general, and in particular to a switch arrangement that is specifically designed to prevent unauthorized removal of the locator apparatus.

2. Description of Related Art

As can be seen by reference to the following U.S. Pat. Nos., 5,640,144; 5,652,569; 5,689,240; and 5,714,931, the prior art is replete with myriad and diverse child monitoring or locating systems.

While all of the aforementioned prior art constructions are more than adequate for the basic purpose and function for which they have been specifically designed, they are uniformly deficient with respect to their failure to provide a simple, efficient, and practical hidden switch arrangement that will insure that the child monitor will be activated once the alarm is removed from the child's person.

While conventional child monitors or locators have become very popular recently, their one serious design flaw involves the fact that they cannot operate in their intended manner if the child is not wearing the device either through the child's own voluntary action, or an involuntary situation precipitated by an abductor.

As a consequence of the foregoing situation, there has existed a longstanding need for a new and improved type of hidden switch arrangement for child locators which will automatically trigger an audible alarm if the locator is removed from the child's person, and the provision of such a construction is a stated objective of the present invention.

BRIEF SUMMARY OF THE INVENTION

Briefly stated, the improved child locator device that forms the basis of the present invention comprises in general, a housing unit, an electronic control unit disposed within the housing unit, and a hidden switch unit which cooperates with the housing unit and the control unit to activate an audible alarm when the housing unit is removed from a child's person.

As will be explained in greater detail further on in the specification, the housing unit is provided with a rear face having a spring loaded clip arm designed to captively engage a child's belt. The clip arm is provided with a magnetic element that is operatively associated with the electronic control unit.

The electronic control unit is substantially enclosed within the housing unit and includes an alarm signal generating speaker which is responsive to a first switch having a magnetic contact which projects through the housing unit adjacent to the magnetic element on the clip arm whereby an alarm signal will be generated when the clip arm is moved outwardly relative to the housing unit.

In addition, the locator device is further provided with a hidden switch unit including a main on-off switch member which is normally covered by the clip arm so that the alarm signal can only be turned off by someone who is aware of the location of the hidden switch unit.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the locator device of this invention disposed on a child's person;

FIG. 2 is a front perspective view of the locator device;

FIG. 3 is a cross sectional view depicting the orientation of the safety switch unit relative to the housing unit and the control unit;

FIG. 4 is a schematic diagram of the control unit; and

FIG. 5 is a partial cut away inverted rear perspective view showing the location of the hidden switch unit relative to the housing unit.

DETAILED DESCRIPTION OF THE INVENTION

As can be seen by reference to the drawings, and in particular to FIG. 1, the improved child locator device that forms the basis of the present invention is designated generally by the reference number 10. The locator device 10 comprises in general a housing unit 11, an electronic control unit 12, and a hidden switch unit 13. These units will now be described in seriatim fashion.

As shown in FIGS. 2, 3, and 5, the housing unit 11 comprises a generally rectangular housing member 20 having a front face 21 provided with an alarm speaker 22 and a bottom surface 23 provided with a permanent label 23' containing data identifying the child and a contact phone number as well as an identifying fingerprint for young infants and or incapacitated children.

In addition, as can best be seen by reference to FIGS. 3 and 5, the rear panel housing member 20 is further provided with an elongated spring loaded clip arm 25 for engaging the locator device 10 to a belt 100 worn on a child's person as shown in FIG. 1. The clip arm 25 is provided with a hook element 26 on its lower end to engage the bottom of the child's belt 100.

Furthermore, the upper portion of the clip arm is provided with a ridged thumb depression to assist a parent or guardian in pivoting the clip arm 25 away from the rear housing panel 24 to facilitate the attachment or disengagement of the device 10 from a child's belt 100. The lower interior portion of the clip arm 25 is further provided with a magnetic element 28 whose purpose and function will be described presently.

As shown in FIGS. 3 through 5, the control unit 12 includes a power source 30 electrically coupled to the following components: a transmitter 31, a receiver 32, the speaker 22, and a double pull-double throw switch 33 having one magnetic contact 34 which projects through the rear face 24 of the housing member 20 adjacent the magnetic element 28 on the interior lower portion of the clip arm 25. The switch 33 is further controlled by the hidden switch unit 13.

As can also be seen by reference to FIGS. 4 and 5, the hidden switch unit 13 comprises an on-off main slide switch member 40 which also projects through the rear face 24 of the housing member 20 and is positioned beneath the normally closed clip arm 25 for reasons that will be explained presently.

To begin with, the placement of the slide switch member 40 behind the clip arm 25 and the relationship between the double pull-double throw switch 33 and the magnetic contact 34 on the rear face 24 of the housing member 20 and the magnetic element 28 on the interior portion of the clip arm 25 are specifically designed to produce a number of safety functions.

First of all the slide switch member 40 is hidden from sight so that an abductor would not readily locate the switch 40 to turn off the alarm signal, nor would most children either have the dexterity or intelligence to locate and access the switch 40 in its intended manner on a voluntary basis or inactivate the switch 40 accidentally by tugging on either the device 10, or the belt 100 from which it would be suspended.

Furthermore, this arrangement requires the parent or guardian to lift up the clip arm 25 to turn the slide switch 40 to the "on" position and also to engage and disengage the locator device 10 to the child's belt 100.

As a consequence, once the clip arm 25 has been raised and the slide switch 40 has been moved to the "on" position, the widely spaced disposition of the magnetic contact 34 and the magnetic element 28 will close the double throw switch 33 to activate the alarm signal speaker 22 until the clip arm 25 has been released to return the magnetic contact 34 and the magnetic element 28 to their closely spaced disposition which will close the double pull-double throw switch 33.

This initial alarm triggering function will alert the parent or guardian by virtue of a weak or non-existent warning signal that the battery 30 will have to be replaced.

Furthermore, when an adult endeavors to remove the locator device 10 from the belt 100, the opening movement of the clip arm 25 required to accomplish this objective will once again trigger the alarm signal, only this time on a continuous basis that will not be interrupted until the adult switches off the main switch 40.

This last feature serves once again to warn about a low battery condition, but more importantly, insures that a continuous warning signal will be transmitted until the main switch 40 is switched to the off position. Not only does this feature conserve battery power, but it also requires that the adult handling the locator device 10 be aware of the location of the hidden slide switch 40 to inactivate the warning signal.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A switch arrangement for a child locator device comprising:

a housing unit having a rear face provided with an elongated spring loaded clip arm; and a control unit disposed within the housing unit and including a battery connected to an alarm signal speaker wherein the switch arrangement comprises first switch means for actuating the alarm signal speaker wherein the first switch means is operatively associated with both the rear face of the housing unit and the spring loaded clip arm such that the alarm signal speaker is actuated when the clip arm is moved away from the rear face of the housing unit; and second switch means for overriding first switch means wherein said second switch means is disposed at a hidden location on said housing unit.

2. The switch arrangement as in claim 1 wherein said second switch means is disposed on the rear face of the housing unit at a location normally covered by said clip arm.

3. The switch arrangement as in claim 1 wherein the housing unit is further provided with a bottom face and the switch arrangement further comprises:

a label permanently affixed to said bottom face and bearing information relative to the child that is wearing the child locator device.

4. A switch arrangement for a child locator device comprising:

a housing unit including a housing member having a rear face and a bottom face wherein the rear face is provided with an elongated spring loaded clip arm;

a control unit including a battery connected to an alarm signal speaker; and first switch means for actuating the alarm signal speaker; wherein the first switch means is operatively associated with both the rear face of the housing unit and the spring loaded clip arm such that the alarm signal speaker is actuated when the clip arm is moved away from the rear face of the housing unit, and including a double pull-double throw switch disposed within the housing unit and having a magnetic contact which extends through the rear face of the housing unit; and, a magnetic element disposed on the clip arm at a location normally adjacent to the rear face of the housing unit.

5. The switch arrangement as in claim 4 further comprising:

second switch means for overriding said first switch means wherein said second switch means is disposed at a hidden location on said housing unit.

6. The switch arrangement as in claim 5 wherein said second switch means is disposed on the rear face of the housing unit at a location normally covered by said clip arm.

7. The switch arrangement as in claim 6 wherein said second switch means comprises:

an on-off slide switch member.

* * * * *